US005671631A

United States Patent [19]

Serizawa et al.

[11] Patent Number: 5,671,631

[45] Date of Patent: Sep. 30, 1997

[54] HOT PLASTIC WORKING METHOD

[75] Inventors: Yoshihisa Serizawa; Yoshiharu Miyake, both of Susono, Japan

[73] Assignee: Toyota Jidosha Kabushiki Kaisha, Japan

[21] Appl. No.: 547,663

[22] Filed: Oct. 24, 1995

[30] Foreign Application Priority Data

Dec. 15, 1994 [JP] Japan ..... 6-312032

[51] Int. Cl.[6] ..... B21C 23/00

[52] U.S. Cl. ..... 72/256; 72/709; 72/377; 72/356

[58] Field of Search ..... 72/709, 253.1, 72/254, 256, 273.5, 377, 356, 359

[56] References Cited

U.S. PATENT DOCUMENTS

| | | | |
|---|---|---|---|
| 1,599,572 | 9/1926 | Lusher . | |
| 5,490,408 | 2/1996 | Ando et al. | 72/256 |

FOREIGN PATENT DOCUMENTS

| | | | |
|---|---|---|---|
| 0919458 | 1/1973 | Canada | 72/709 |
| 0 610 006 | 8/1994 | European Pat. Off. . | |
| 2236613 | 2/1975 | France | 72/709 |
| 728 857 | 12/1942 | Germany . | |
| 0053325 | 3/1983 | Japan | 72/273.5 |
| 5-504602 | 7/1993 | Japan . | |
| 5-305332 | 11/1993 | Japan . | |
| 1 254 884 | 11/1971 | United Kingdom . | |
| 1456050 | 11/1976 | United Kingdom | 72/709 |
| WO91/13181 | 9/1991 | WIPO . | |

OTHER PUBLICATIONS

"Advances in Superplasticity and in Superplastic Materials", Oleg D. Sherby ISIJ International, vol. 29, No. 8, 1989, pp. 698–716.

European Search Report dated Mar. 18, 1996 (2 pages).

Communication dated Apr. 12, 1996 (1 page).

Information List (1 page).

*Primary Examiner*—Lowell A. Larson

*Assistant Examiner*—Ed Tolan

*Attorney, Agent, or Firm*—Finnegan, Henderson, Farabow, Garrett & Dunner, L.L.P.

[57] ABSTRACT

To provide a hot working method which can reduce working resistance during the early stage of hot plastic working, particularly extrusion and forging using a die.

A hot plastic working method characterized by comprising the step of plastically working, using a die, a material having a structure of not more than 50 μm in average grain diameter with dispersed spherical grains ranging in size from 10 to 200 nm, the working material having a recess formed on a surface thereof in its site facing a closed space formed by abutting the working material against the die surface at the time of plastic working.

7 Claims, 4 Drawing Sheets

HOT PLASTIC WORKING METHOD

BACKGROUND OF THE INVENTION

1. Field of the Invention

The present invention relates to a hot plastic working method which can reduce working resistance during the early stage of hot plastic working, particularly extrusion and forging using a die.

2. Description of the Related Art

In hot plastic working, reducing the working resistance is important to working energy saving, broadening of the range in which plastic working is possible and the like. The working temperature, working speed, dies, shape of the material, and the like are taken into consideration in order to reduce the working resistance. Further, from the viewpoint of the quality of the material, soft materials can theoretically reduce the working resistance. The selection of the soft materials, however, results in lowered strength of the resultant worked product.

This will be further described by taking extrusion as an example. It is generally said that high-strength materials which are excellent in strength properties as a member have low extrudability. That is, since such materials have high deformation resistance during extrusion, they are unsuitable for extrusion of products having a complicated section and, in addition, the productivity is low. For example, in the extrusion of Al alloys, soft alloys (such as JIS 6000 series) having excellent extrudability are extensively used in the art, and alloys having high strength which are originally required of transportation such as automobiles have limited use due to their poor extrudability.

Therefore, the use of superplastic materials, characterized by high strength and low deformation resistance, as working materials may be considered. Regarding known techniques in this field, for example, Publication No. 5-504602 of the Translation of International Patent Application discloses a superplastic molding method wherein, in order to improve the workability, a material, which shows superplastic behavior, prepared by compression-molding a rapidly solidified alloy powder of an Mg—Al—Zn—base alloy is subjected to a molding operation, i.e., extrusion and die forging, under controlled working temperature and working speed conditions.

The use of the materials having superplastic behavior as the extrusion material certainly results in lowered extrusion resistance. Mere use of the superplastic material or a combination of the use of the superplastic material with a known die or a selected shape of the extrusion material, however, does not always result in satisfactory superplastic deformation at a site influencing the extrusion resistance, that is, at a site in the vicinity of a die hole. Consequently, a lowering of the working resistance to such an extent as will be expected from the superplasticity of the material cannot be attained, making it difficult to sufficiently utilize the superplasticity. This problem is experienced in plastic working, such as hot die forging, as well as in extrusion, and when plastic working is carried out so as to exactly trace a die surface having a complicated shape, mere use of a material having superplastic behavior does not result in satisfactory utilization of the superplasticity. For this reason, the development of a working method, which can utilize superplastic behavior and, at the same time, lower the working resistance, has been desired in the art.

SUMMARY OF THE INVENTION

In order to solve the above problems, the present invention provides a hot plastic working method, which can lower the working resistance even when the working material has high strength, through studies on means for lowering the working resistance in hot plastic working, especially working which is restricted by the die used and conducted under compression stress, such as hot extrusion and forging.

More specifically, an object of the present invention is to provide a hot plastic working method wherein, in order to maximize the utilization of the superplastic behavior in hot plastic working using a die, preliminary plastic working is applied to a working material at a site facing a closed space of the die surface defined by the working material and the die surface immediately before plastic working, thereby enabling the working resistance to be reduced in subsequent main working.

The gists of the present invention are as follows.

(1) A hot plastic working method comprising the step of plastically working, using a die, a material having a structure of not more than 50 μm in average grain diameter with dispersed spheroidal grains ranging in size from 10 to 200 nm, the working material having a recess formed on a surface thereof, in its site facing a closed space formed by abutting the working material against the die surface at the time of hot plastic working.

(2) The hot plastic working method according to item 1, wherein the hot plastic working is an extrusion to reduce the extrusion resistance utilizing a superplasticity of the working material.

(3) The hot working method according to item (1) or (2), wherein the working material is subjected to preliminary, hot plastic working in the site facing the closed space formed immediately before the working by abutting the working material against the die surface, and subsequently the material is subjected to main hot plastic working.

(4) The hot working method according to item (1), wherein the recess is hemispherical, conical, columnar or circular truncated.

(5) The hot working method according to item (1) or (2), wherein the working material comprising Al—Mg, Cu—Zn, Cu—Al or Ni—Ti alloys exhibiting a superplasticity at the working temperature.

(6) The hot working method according to item 1 or 2, wherein a sectional configuration of the working material is spherical, polygonal or irregular.

(7) The hot working method according to item (2), wherein the extrusion conditions are 300° to 500° C. of a container temperature and $10^{-3}$/S to $10^{0}$/S of extrusion rate.

BRIEF DESCRIPTION OF THE DRAWINGS

The present invention will be more apparent from the description of the preferred embodiments set forth below, with reference to the accompanying drawings, in which.

DESCRIPTION OF THE PREFERRED EMBODIMENTS

Figure 1:
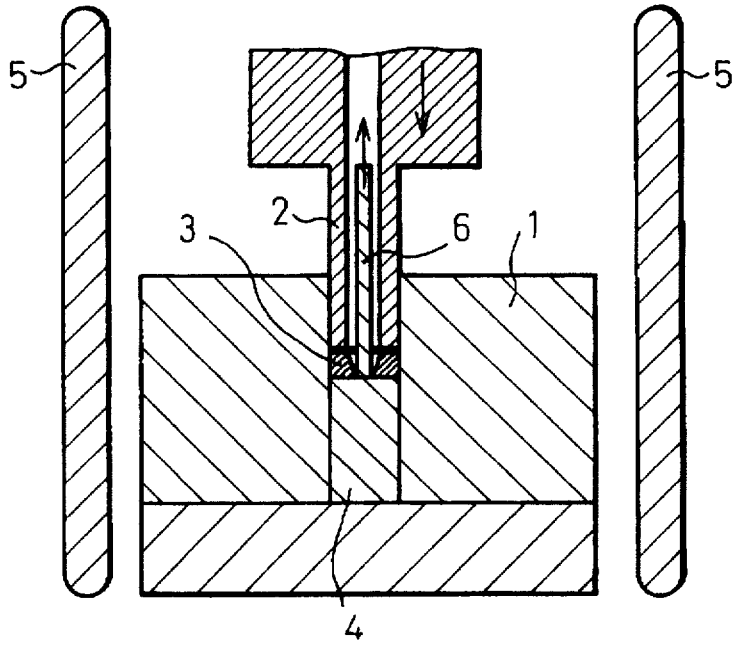
FIG. 1 is an extrusion equipment according to an example of the present invention.

The recess formed in a surface of the working material in its site facing the closed space and the recess formed in the front end of the extrusion material serve to concentrate the pressure, applied to the working material during the early stage in plastic working such as forging or extrusion, on the recess. Since the recess in the working material is formed at a position corresponding to the position of the closed space or the position of the die hole, the working material in its interior region corresponding to the closed space or in its position corresponding to the position of the die hole is subjected to preliminary plastic working before main working.

For this reason, when the material is a superplastic material having a structure possessing specified average grain diameter and dispersed grains, dynamic crystallization occurs in the above position, resulting in previous refinement of the grain structure and superplastic flow in the interior of the material. This accelerates the superplastic flow in main working, contributing to a lowering of the working resistance in the subsequent plastic working. In the case of extrusion, the acceleration of the superplastic flow continuously occurs also in stationary working state subsequent to the initial superplastic flow during the early stage of working, enabling the working resistance to be lowered in both the early stage of the working and the stationary working state.

The first technical feature of the present invention resides in the utilization of superplastic behavior of a working material. Specifically, as a result of studies on hot plastic working, the present inventors have found that, in hot plastic working, superplastic dynamic recrystallization can be developed by previously concentrating a compressive plastic flow in a position where a working material is restrained by a die surface having a recess to form a closed space. Further, they have found that, since the working resistance in main working can be markedly lowered by virtue of the above effect, the effect is equivalent to the effect attained when ductility is previously imparted to the material immediately before working and that once the superplastic behavior is developed with this position as the starting point, it can be continued so far as the main working is continuously carried out. The present invention has been made based on these findings.

The reasons for the limitation of the structure of the material according to the present invention will now be described.

There are a large number of materials usable in plastic working, particularly extrusion. In the present invention, the material used should have a structure of not more than 50 μm in average grain diameter with homogeneously dispersed spherical grains ranging in size from 10 to 200 nm and, at the same time, develop such superplastic behavior that the tensile elongation at a high temperature exceeds 200%.

A material having a structure of more than 50 μm in average grain diameter with dispersed spherical grains ranging in size from 10 to 200 nm and capable of developing the so-called "superplastic behavior" can be used as the material of the present invention. For example, structures in Al alloys such as Al—Zn—Mg—Cu—Cr, Al—Cu—Zr—Mg—Fe—Zn, Al—Li—Cu—Mg—Zr, and Al—Mg—Cu—Mn—Cr; Cu alloys such as Cu—Zn and Cu—Al—Ni—Fe—Mn; Zn alloys such as Zn—Al, Zn—Al—Cu, and Zn—Al—Cu—Mg; and other superplastic alloys of Ni, Ti, Fe and the like can satisfy the above requirements.

The shape of the recess formed in the end face of the material will now be described.

Billets used in extrusion are, in many cases, in a cylindrical form and have a flat worked end face.

In the present invention, a material having superplastic behavior is selected as the working material, and the refinement of the grain structure by dynamic recrystallization occurs during working. Consequently, transgranular slip is reduced, and the deformation is mainly caused by intergranular deformation, enabling the extrusion resistance to be lowered. More effective lowering of the extrusion resistance can be expected by accelerating the refinement of the grain structure by the dynamic recrystallization in a wide region in the interior of the billet.

By taking advantage of this, the present invention has enabled the refinement of the grain structure in the interior of a billet by dynamic recrystallization to be accelerated by providing a recess in the front end face of the billet on the die side. In the present invention, the recess is preferably in the form of a hemisphere, a cone, a cylinder, or a circular truncated cone from the viewpoint of avoiding uneven stress. The diameter of the circle in the opening is preferably 0.7 to 2.0 times larger than that of the hole of the die which is assumed to be circular. The depth (height) of the recess preferably falls within substantially the same range as the diameter of the opening.

Examples of the present invention will now be described with reference to the accompanying drawings.

EXAMPLE 1

An extrusion equipment used in this example of the present invention is shown in FIG. 1. In the drawing, numeral 1 designates a container, numeral 2 a stem, numeral 3 a die, and numeral 4 an extrusion billet. The temperature of the whole extrusion equipment is controlled at an identical temperature by means of a heater 5. The extrusion is upward indirect extrusion wherein the die 3 is pushed down upon descent of the stem 2, thereby extruding the extrusion billet 4 into a section 6 as a product. The die used was a circular die provided with a hole having a diameter of 2 mm.

Figure 2:
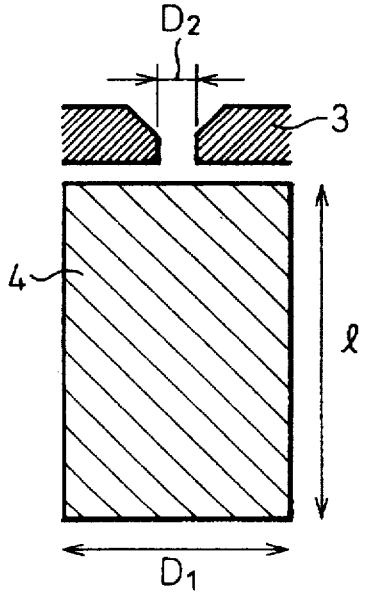
FIG. 2 is a diagram showing an extrusion material and a die hole according to an example of the present invention.

FIG. 2 shows the geometry of the billet used in this example. The billet was a cylindrical billet 4 having a material diameter $D^1$=7 (mm) and a height l=10.5 (mm). In the conventional extrusion, the ratio of the die hole diameter $D_2$ to the material diameter $D_l$ is determined by the extrusion ratio (sectional area of billet/sectional area of die hole) which is determined by taking into consideration the material and the properties of the product. In the case of the superplastic material as used in the present invention, the extrusion ratio is preferably set to not less than about 10.

The material used in this example is an Al—Mg—base alloy having a superplastic property, indicated by symbol A, as specified in Table 1. It had a fine-grain structure characteristic of superplastic materials and a superplastic elongation of 300% as measured under conditions of a temperature of 400° C. and a strain rate of $10^{-2}$/S. The Al—Mg—base alloy indicated by symbol B is a conventional material used as a comparative material. Although this comparative material has the same composition as the material A of the present invention, it has neither a superplastic property nor a small grain diameter.

TABLE 1

| Symbol | Classification | Alloy system | Avg. grain dia. (μm) | Spherical dispersed grains | Max. tensile elongation (%) |
|---|---|---|---|---|---|
| A | Material of inv. | Al—Mg-base alloy (Al—10 Mg—0.1 Zr) | 20 | Present | 300 |
| B | Comp. material | Al—Mg-base alloy (Al—10 Mg—0.1 Zr) | 100 | Absent | 15 |

In the present example, the extrusion conditions were such that the container temperature was varied from 350° to 450° C., the extrusion rate was $10^{-3}$/S to $10^{0}$/S in terms of the strain rate, and a graphite-based lubricant was used as a lubricant. The extrusion resistance was evaluated in terms of a peak stress and a stationary stress created during extrusion.

Figure 3A:
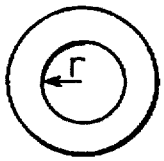
FIGS. 3(*a*) and 3(*b*) are a top plan view, and a sectional view, respectively, showing the shape of a recess according to an example of the present invention.
Figure 3B:
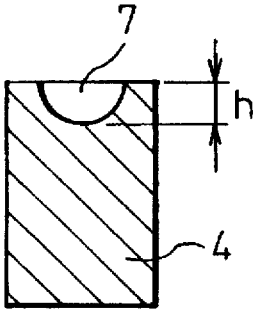

FIGS. 3(*a*) and 3(*b*) show a top plan view and a sectional view, respectively, of the geometry of a recess 7 formed in the material used in the present example. The recess 7 is provided in the front end of the extrusion billet 4. In the drawing, r represents the radius of the recess 7, and h represents the height (depth) of the recess 7.

Figure 4A:
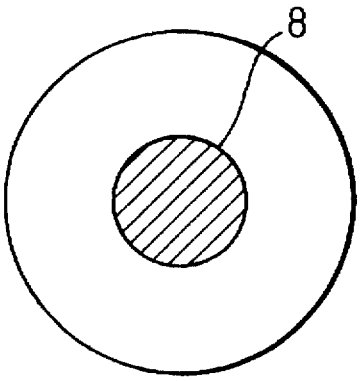
FIGS. 4(*a*) and 4(*b*) show a circular section and a irregular section, respectively, of a extrusion die according to an example of the present invention.
Figure 4B:
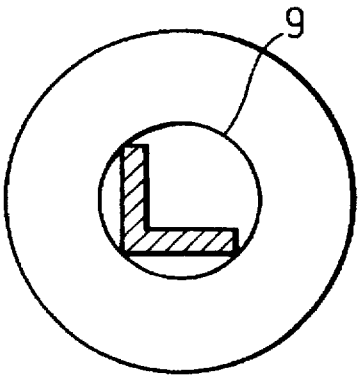
Figure 5A:
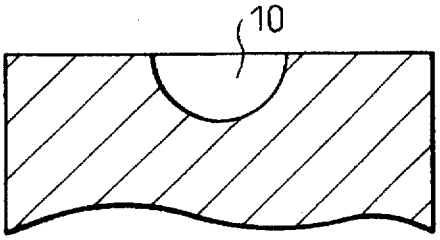
FIG. 5(*a*) shows a hemispherical recess, FIG. 5(*b*) a conical recess, FIG. 5(*c*) a columnar recess, and FIG. 5(*d*) a circular truncated recess.
Figure 5B:
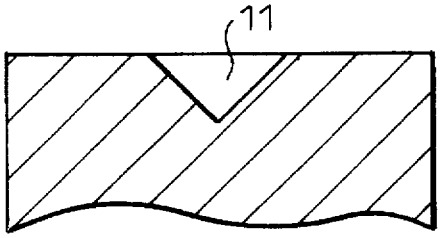
Figure 5C:
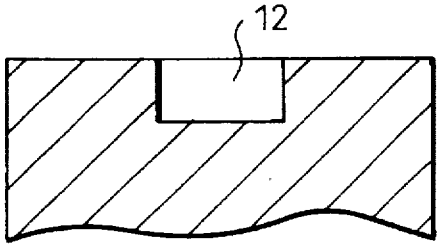
Figure 5D:
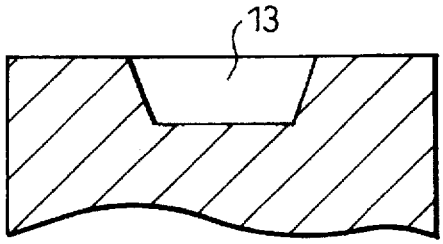

FIGS. 4(*a*) and 4(*b*) are diagrams of circular and a irregular section, respectively, showing the relationship between the die hole and the position and radius E of the recess 7. The geometry of the recess in the case of a die 8 having a circular section and a die 9 having a irregular section are shown in these drawings. In the drawing, the hatched region represents the shape of the die hole, and the circle surrounding the hatched region represents the shape of the recess. In the present invention, the circle, having the radius r, constituting the recess is preferably circumscribed with at least the die hole. FIGS. 4(*a*) and 4(*b*) show this state. More specifically, the radius r of the recess is determined by the relationship between the radius r of the recess and the radius of the circle circumscribed with the die hole (equivalent circular radius in the case of an irregular section). However, the radius to height ratio of the recess should be limited so as not to cause cracking of the billet during extrusion.

FIGS. 5(*a*)–5(d) show embodiments of the recess in the present example, wherein FIG. 5(*a*) shows a hemispherical recess 10, FIG. 5(*b*) a conical recess 11, FIG. 5(*c*) a columnar recess 12, and FIG. 5(*d*) a circular truncated recess 13. In the present example, evaluation was carried out on recesses in these forms.

The results of evaluation, in the present example, based on the extrusion stress proportional to the working resistance will now be summarized.

Figure 6:
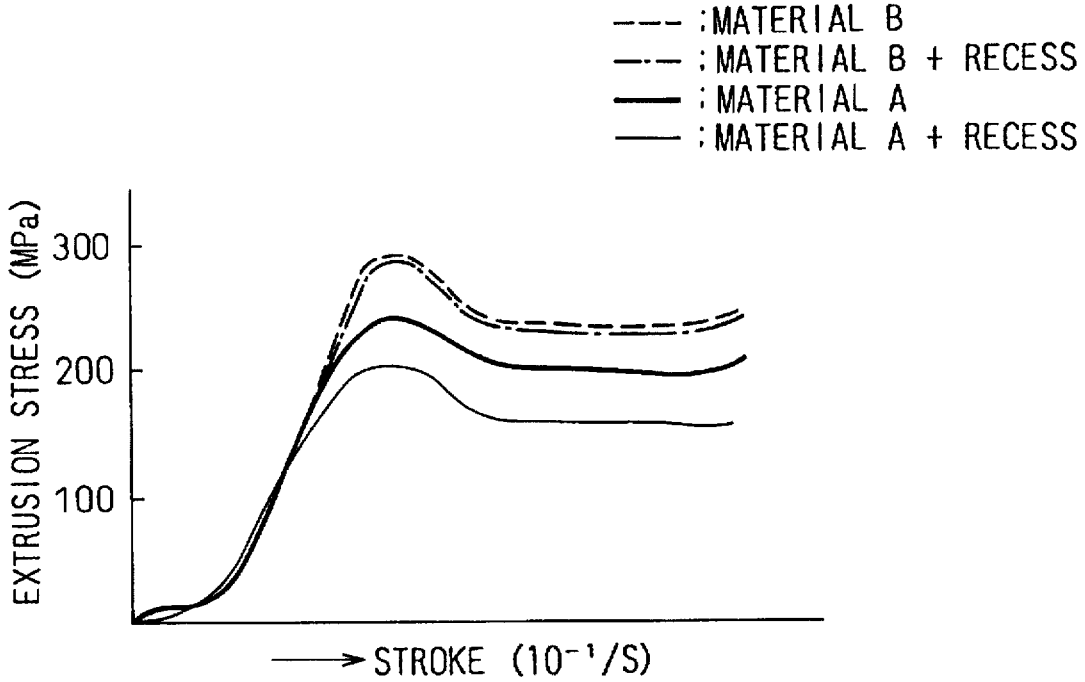
FIG. 6 is a diagram showing an extrusion stress-stroke curve illustrating the relationship between the extrusion stress and the working stroke according to an example of the present invention.

FIG. 6 shows the results of experiments using the materials A and B, i.e., an experiment wherein a hemispherical recess shown in FIG. 5(*a*) was provided in the front end face of the billet and an experiment wherein the front end face of the billet was flat. In this case, the die hole diameter was 2 mm, and the radius of the recess was 4 mm. The temperature of the container was 400° C., and the extrusion rate was $10^{-1}$/S in terms of the strain rate. An extrusion stress-stroke curve showing the relationship between the extrusion stress corresponding to the deformation stress created during extrusion and the working stroke. In this curve, the maximum value of the extrusion stress is a peak stress, and a substantially constant extrusion stress value appearing after the peak stress is stationary stress.

The use of the material A having a superplastic property resulted in lowered extrusion stress, that is, lowered extrusion resistance, as compared with the use of the material B, even when the front end face of the billet was flat. A further marked lowering of the extrusion stress could be attained by providing a recess in the front end face of the billet formed of the material A. On the other hand, regarding the material B, no difference in extrusion stress was observed between the billet with a recess formed in the front end and the billet with no recess formed in the front end. The same results were obtained in experiments on recesses in various forms as shown in FIGS. 5(*b*) to (*d*).

The above results demonstrate that the provision of a recess results in lowered extrusion stress only when the material extruded has a superplastic property.

EXAMPLE 2

Figure 7:
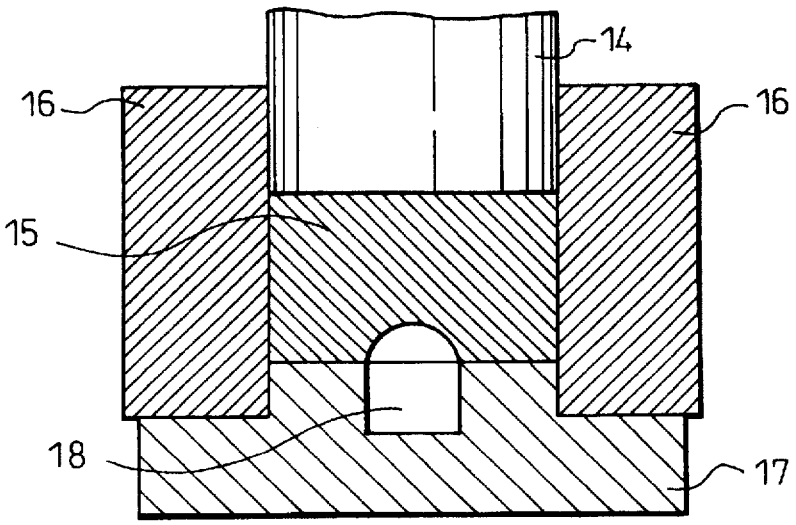
FIG. 7 is a schematic diagram showing die forging according to an example of the present invention.

FIG. 7 shows another embodiment of the present invention wherein the present invention is applied to die forging. In the drawing, numeral 1 is a container, numeral 2 a stem, numeral 4 extrusion billet, and numeral 5 heater. A forging material 15 has superplastic behavior characteristic of the present invention and die-forged, by means of a upper die 16, a lower die 17, and an upper punch, into a shape including space 18 (corresponding to a closed space) provided in the lower die 17. As in the case of Example 1, the material used in the present example was an Al—Mg—base alloy, having a superplastic property, indicated by symbol A. It had a fine-grain structure characteristic of superplastic materials and a superplastic elongation of 300% as measured under conditions of a temperature of 400° C. and a strain rate of $10^{-2}$/S. The conventional Al—Mg—base alloy indicated by symbol B was used as a comparative material. Although this comparative material has the same composition as the material A of the present invention, it has neither a superplastic property nor a small grain diameter.

Conditions for the die forging in this example were such that the die temperature was varied from 350° to 450° C., and the forging rate was $10^{-3}$/S to $10^{0}$/S in terms of the strain rate. The forging resistance was evaluated as described in Example 1.

Further, as in the case of Example 1, evaluation was carried out on recesses in hemispherical, conical, columnar recess, and circular truncated forms.

Also in the present example, the use of the material A having a superplastic property resulted in markedly lowered forging resistance even when the lower end face of the forging material was flat, as compared with the use of the material B. Only for the material A, a further marked lowering of the forging stress could be attained by providing a recess in the lower end face of the forging material. The same results were obtained in experiments on recesses in the above various forms.

Also in the present example, it was found that the formation of a recess in a material, in its surface to be worked, facing a recessed closed space defined by the drag 17 and the material can result in lowered working resistance during die forging.

The present invention can lower working resistance during hot plastic working and lower the maximum working stress during the early stage of working, which enables a high-strength material to be plastically worked with energy saving, resulting in the realization of the manufacture of products having increased strength by working. In addition, the present invention, by virtue of low stress working, can contribute to reduction of working cost and the manufacture of products by hot plastic working with high productivity.

We claim:

1. A hot plastic working method comprising the steps of:

providing a working material with a structure having an average grain diameter of not more than 50 μm and dispersed spheroidal grains ranging in size from 10 to 200 μm;

forming a recess circumscribed with a die hole on a surface at an end portion of said working material;

setting said working material in a hot working die having a same inner configuration of said die hole from entry side to outlet side;

providing heating equipment to heat both said working material and said die; and hot plastic working said working material so that said recess faces to the site of a closed space formed by abutting said working material against said die at the time of hot plastic working.

2. The hot plastic working method, according to claim 1, wherein said hot plastic working is an extrusion to reduce the extrusion resistance utilizing a superplasticity of the working material.

3. The hot working method according to claim 1 or 2, wherein the working material is subjected to preliminary, hot plastic working in the site facing the closed space formed immediately before said working by abutting said working material against the die surface, and subsequently said material is subjected to main hot plastic working.

4. The hot working method according to claim 1, wherein said recess is hemispherical, conical, columnar or circular truncated.

5. The hot working method according to claim 1 or 2, wherein said working material comprising Al—Mg, Cu—Zn, Cu—Al, or Ni—Ti alloys exhibiting a superplasticity at the working temperature.

6. The hot working method according to claim 1 or 2, wherein a sectional configuration of said working material is spherical, polygonal or irregular.

7. The hot working method according to claim 2, wherein the extrusion conditions include a die temperature of 300° to 500° C. and an extrusion rate of $10^{-3}$/S to $10^{0}$/S.

* * * * *